US010435280B2

(12) United States Patent
Goncalves et al.

(10) Patent No.: US 10,435,280 B2
(45) Date of Patent: Oct. 8, 2019

(54) SYSTEM AND METHOD FOR IMPROVING LIFT CYLINDER BUCKLING RESISTANCE

(71) Applicants: Fernando D Goncalves, Vestal, NY (US); William Doak, Apalachin, NY (US); Paul F Finnegan, Windsor, NY (US)

(72) Inventors: Fernando D Goncalves, Vestal, NY (US); William Doak, Apalachin, NY (US); Paul F Finnegan, Windsor, NY (US)

(73) Assignee: The Raymond Corporation, Greene, NY (US)

( * ) Notice: Subject to any disclaimer, the term of this patent is extended or adjusted under 35 U.S.C. 154(b) by 230 days.

(21) Appl. No.: 14/819,513

(22) Filed: Aug. 6, 2015

(65) Prior Publication Data

US 2016/0039649 A1 Feb. 11, 2016

Related U.S. Application Data

(60) Provisional application No. 62/034,250, filed on Aug. 7, 2014.

(51) Int. Cl.
*B66F 9/08* (2006.01)
*B66F 9/22* (2006.01)

(52) U.S. Cl.
CPC . *B66F 9/08* (2013.01); *B66F 9/22* (2013.01)

(58) Field of Classification Search
CPC ..... B66F 9/08; B66F 9/22
See application file for complete search history.

(56) References Cited

U.S. PATENT DOCUMENTS

| | | | | | |
|---|---|---|---|---|---|
| 2,595,959 | A * | 5/1952 | Lawless | B66F 9/08 | 187/224 |
| 2,670,811 | A * | 3/1954 | Shaffer | B66F 9/22 | 187/229 |
| 2,877,868 | A * | 3/1959 | Gunning | B66F 9/08 | 187/229 |
| 3,534,664 | A * | 10/1970 | Ulinski | B66F 9/08 | 187/226 |
| RE27,731 | E * | 8/1973 | McIntosh | B66F 9/08 | 187/227 |
| 3,841,442 | A * | 10/1974 | Erickson | B66F 9/08 | 187/226 |
| 3,970,171 | A * | 7/1976 | Honecker | B66F 9/08 | 187/234 |
| 4,503,935 | A * | 3/1985 | Haffer | B66F 9/08 | 187/229 |
| 4,848,520 | A * | 7/1989 | Gibel | B66F 9/082 | 187/223 |
| 6,193,015 | B1 * | 2/2001 | Kato | B66F 9/08 | 187/226 |
| 7,407,038 | B2 * | 8/2008 | Warner | B66F 9/08 | 182/2.11 |
| 2014/0262626 | A1 * | 9/2014 | Yahner | B66F 9/22 | 187/229 |

* cited by examiner

*Primary Examiner* — Minh Truong
(74) *Attorney, Agent, or Firm* — Quarles & Brady LLP

(57) ABSTRACT

A lift truck can include a mast and a lift cylinder. The lift cylinder can include a piston rod and a cylinder housing. The lift truck also can include a piston rod retention mechanism that restricts movement of the lift cylinder in a direction lateral to an axial direction when the mast is in an extended position.

20 Claims, 8 Drawing Sheets

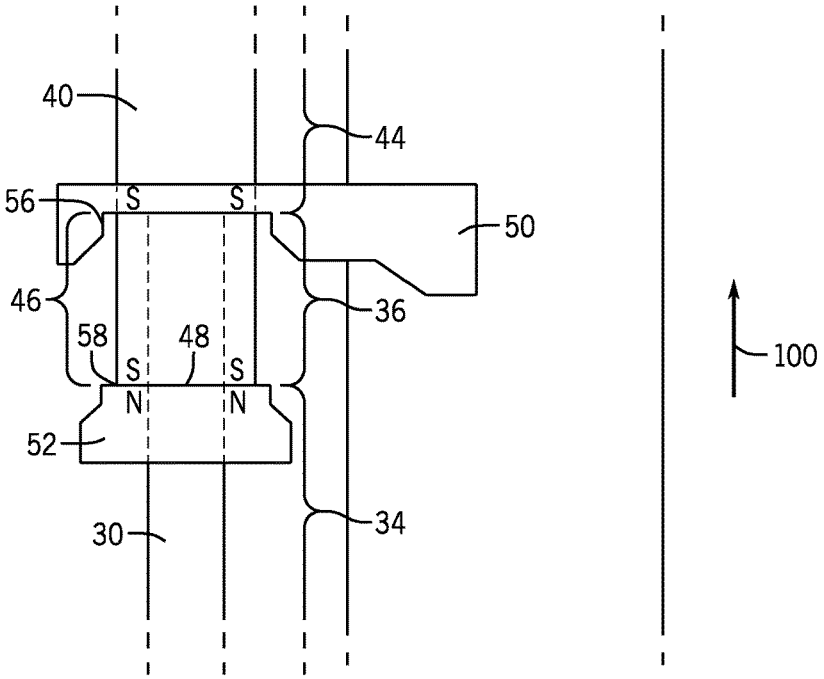
FIG. 4
FIG. 5
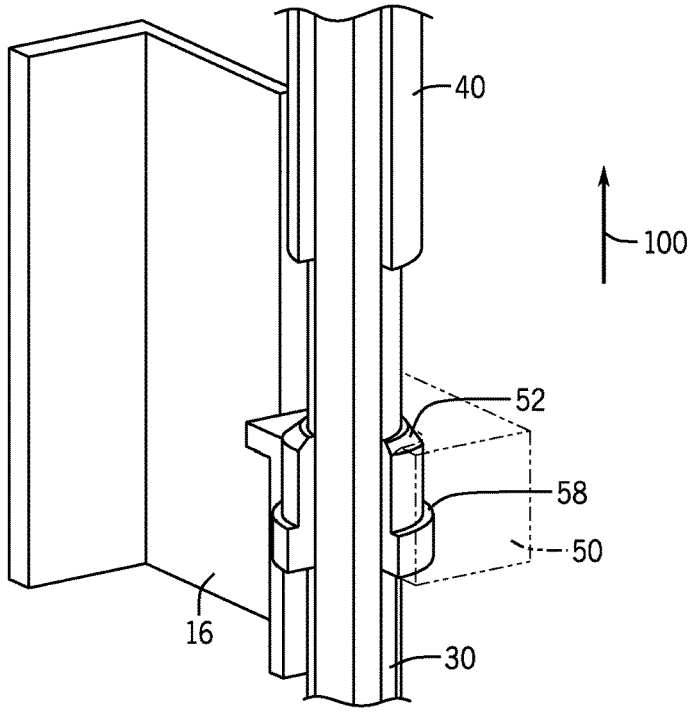

FIG. 10
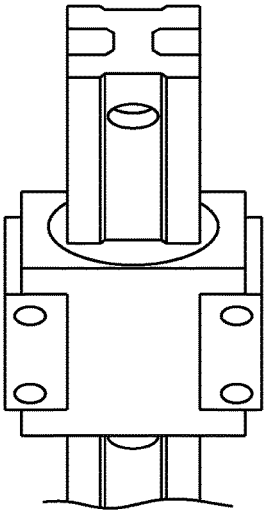
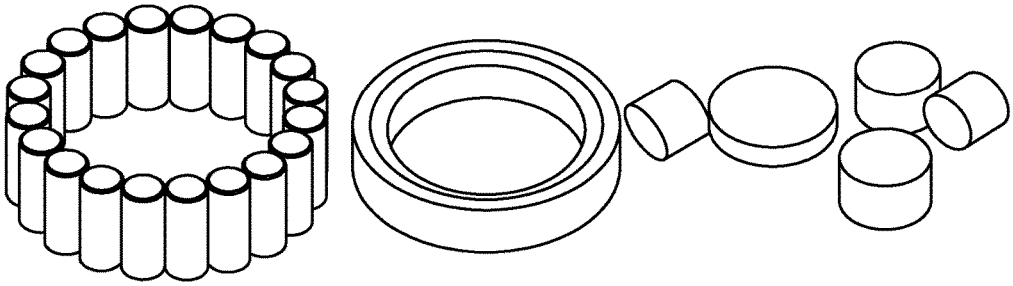
FIG. 11

SYSTEM AND METHOD FOR IMPROVING LIFT CYLINDER BUCKLING RESISTANCE

CROSS-REFERENCE TO RELATED APPLICATIONS

This application claims priority to U.S. Provisional Patent Application No. 62/034,250, filed Aug. 7, 2014, the entire contents of which are incorporated by reference herein.

STATEMENT CONCERNING FEDERALLY SPONSORED RESEARCH OR DEVELOPMENT

Not applicable.

FIELD OF THE INVENTION

The present invention relates to the field of industrial lift trucks, and more specifically to retention mechanisms for preventing buckling of lift cylinders.

BACKGROUND OF THE INVENTION

Lift trucks are designed in a variety of configurations to perform a variety of tasks. Most tasks include the operation of a vertically movable platform to lift and lower a load, such as materials on a pallet. Lift cylinders are operable to lift and lower the load. The lift cylinders typically operate within an extendable mast.

Reach trucks and other high-lift material handling vehicles are designed to lift loads to high elevated heights. The capacity that these vehicles can lift to such heights is constrained by many factors, one of which is the buckling resistance of the lift cylinders. As the rated capacity and elevated height of the vehicle increases, lift cylinder buckling resistance can become a limiting factor due to the increased unsupported length of the piston rod. To counter this, the diameter of the piston rod and cylinder are often increased to sustain the axial buckling load induced by the load on the forks. The critical buckling load ($P_{cr}$) as defined in classical Euler buckling theory can be expressed as $$P_{cr} = \frac{\pi^2 EI}{L_e^2} \tag{1}$$

where E is Young's modulus, $L_e$ is the effective length of the rod, and I is the moment of inertia. In the case of round bar for example, the moment of inertia may be given by $$I = \frac{\pi D^4}{64} \tag{2}$$

for a bar of diameter D. As demonstrated by equation (1), as the diameter (D) increases, the load needed to buckle the cylinder increases. Increasing the lift cylinder size, however, can have negative performance impacts on the vehicle.

It would therefore be desirable to identify alternative systems and methods to improve the buckling resistance of the lift cylinders.

SUMMARY OF THE INVENTION

The present invention overcomes the drawbacks of the previous lift truck systems and methods by improving the buckling resistance of lift cylinders.

In one aspect of the invention, a lift truck having a mast is provided. The lift truck comprises a mast.

In one embodiment, the mast can include a first mast section, a second mast section, a lift cylinder, and a piston rod retention mechanism. The first mast section can include a first mast rail member. The second mast section can include a second mast rail member. The second mast rail member can be movably coupled to the first mast rail member and movable along an axial direction relative to the first mast rail member between a retracted position and an extended position. The lift cylinder can include a piston rod and a cylinder housing. The piston rod can have an outer piston rod diameter and a piston rod bottom. The cylinder housing can be disposed concentrically about the piston rod and movably coupled to the piston rod along the axial direction. The cylinder rod housing can have a cylinder housing top and an outer cylinder housing diameter that can be larger than the outer piston rod diameter. The piston rod retention mechanism can be affixed to the first mast rail member. The lift cylinder can be operable to extend and retract the mast in the axial direction by moving the second mast section with respect to the first mast section. The piston rod retention mechanism restricts movement of the lift cylinders in a direction lateral to the axial direction when the mast is in the extended position.

In another embodiment, the mast can include a first mast section, a second mast section, a lift cylinder, and a piston rod retention mechanism. The first mast section can include a first mast rail member. The second mast section can include a second mast rail member movably coupled to the first mast rail member along an axial direction. The lift cylinder can include a piston rod having an outer piston rod diameter and a cylinder housing disposed concentrically about the piston rod and movably coupled to the piston rod along the axial direction. The piston rod retention mechanism can include a fixed portion having an internal shape to enable movable coupling between the cylinder housing and the fixed portion and a selectively coupled portion or selectively engaged portion having an internal shape to enable movable coupling between the piston rod and the selectively coupled portion or selectively engaged portion.

In another aspect of the invention, a piston rod retention mechanism is provided. The piston rod retention mechanism can be for use with a lift cylinder having a piston rod and a cylinder housing. The piston rod can have an outer piston rod diameter. The piston rod can be movably coupled to the cylinder housing. The cylinder housing can be disposed concentrically about the piston rod. The cylinder housing can have an outer cylinder housing diameter that can be larger than the outer piston rod diameter. The cylinder housing moves in an axial direction relative to the piston rod. The piston rod retention mechanism can include a retention fixture and a selectively coupled portion or selectively engaged portion. The retention fixture can have an internal shape to enable movable coupling between the cylinder housing and the retention fixture. The cylinder housing can be positioned within the retention fixture in a retracted position and can be positioned outside the retention fixture in an extended position. The selectively coupled portion or selectively engaged portion can have an internal shape to enable movable coupling with the piston rod and the selectively coupled portion or selectively engaged portion. The selectively coupled portion can be selectively coupled to a bottom of the cylinder housing in the retracted position. The selectively coupled portion can be coupled to the fixed portion and decoupled from the bottom of the cylinder housing by the movement from the retracted position to the extended position. The selectively coupled portion can be selectively decoupled from the fixed portion and coupled to the bottom of the cylinder housing by the movement from the extended position to the retracted position. The selectively engaged portion can be engaged to the fixed portion by the movement from the retracted position to the extended position. The selectively engaged portion can be disengaged from the fixed portion by the movement from the extended position to the retracted position.

In some embodiments, the mast further comprises a cylinder housing retention mechanism. The cylinder housing retention mechanisms can be coupled to the second mast section and movably coupled to the cylinder housing.

In other embodiments, the piston rod retention mechanism or the cylinder housing retention mechanism are positioned to at least double a critical bucking load of the lift cylinder in the extended position in relation to a critical buckling load of the lift cylinder in the extended position in the absence of the piston rod retention mechanism or the cylinder housing retention mechanism.

In yet other embodiments, the piston rod retention mechanism engages the piston rod and the cylinder housing retention mechanism engages the cylinder housing when the mast is in the extended position.

In other embodiments, the piston rod can have an exposed portion that is positioned outside the cylinder housing when the mast is in the extended position and an internal portion that is positioned within the cylinder housing when the mast is in the extended position, wherein the cylinder housing can have an empty portion that does not have the piston rod positioned within it when the mast is in the extended position and a filled portion that has the piston rod positioned within it when the mast is in the extended position, and wherein the piston rod retention mechanism can be positioned at a position along the exposed portion of the piston rod at a distance from the piston rod bottom between about 1% and about 99% of the length of the exposed portion, wherein the cylinder housing retention mechanism can be at a position along the filled portion of the cylinder housing, wherein the cylinder housing retention mechanism can be at a position along the empty portion of the cylinder housing at a distance from the cylinder housing top between about 1% and about 99% of the length of the empty portion, or a combination thereof.

In some embodiments, the piston rod retention mechanism can include a piston rod retention fixture and a selectively coupled portion or a selectively engaged portion.

In some embodiments, the selectively coupled portion couples to the piston rod retention fixture when the mast is in an extended position, the selectively coupled portion couples to the cylinder housing when the mast is in a retracted position, the selectively engaged portion engages the piston rod when the mast is in the extended position, and the selectively engaged portion disengages the piston rod when the mast is in the retracted position.

In some embodiments, the piston rod retention fixture comprises a retention bushing capture. The lift cylinder can be hydraulic.

In some embodiments, the piston rod bottom can be affixed to the first mast section, the cylinder housing can be affixed to the second mast section, or a combination thereof.

In some embodiments, the selectively coupled portion or the selectively engaged portion can be selectively engaged to the piston rod or selectively coupled to the fixed portion by magnetic forces, by spring-like forces, by linear actuation forces, or a combination thereof. In some embodiments, the selectively engaged portion can be a retention fork and the selectively coupled portion can be an autocoupling bushing.

The foregoing and other objects and advantages of the invention will appear in the detailed description which follows. In the description, reference is made to the accompanying drawings which illustrate a preferred embodiment.

BRIEF DESCRIPTION OF THE DRAWINGS

FIG. 4 is a schematic of a piston rod retention mechanism according to the present invention;

FIG. 5 is a three-dimensional model of a piston rod retention mechanism according to the present invention;

FIG. 10 is an alternative linear bushing;

FIG. 11 shows magnets suitable for forming the magnetic couple of the present invention.

DETAILED DESCRIPTION OF THE PREFERRED EMBODIMENT

Figure 1:
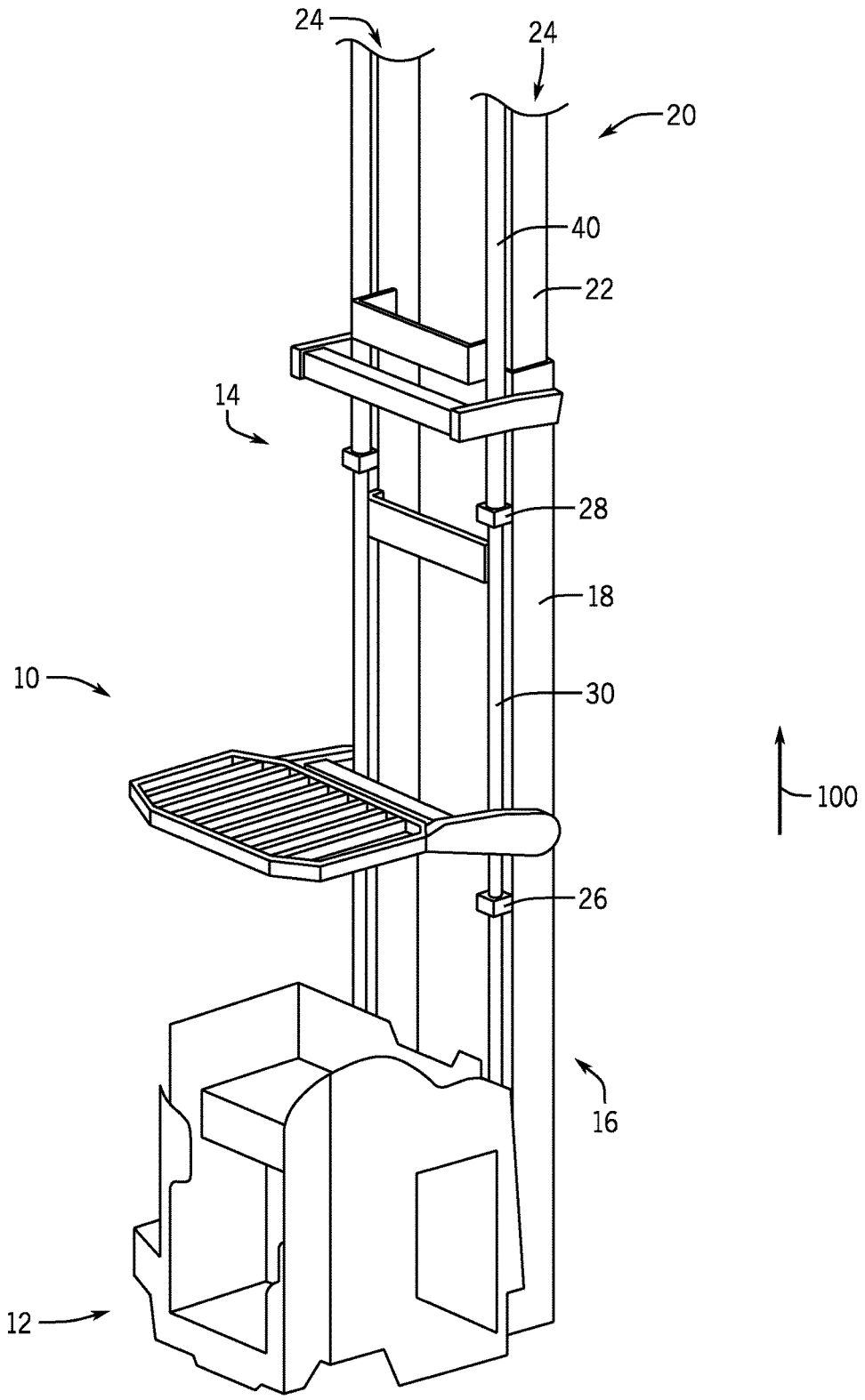
FIG. 1 is a perspective view of a lift truck according to the present invention.

Referring now to the Figures, and more particularly to FIG. 1, the general arrangement of a representative material handling vehicle, reach truck, or lift truck 10 in accordance with a preferred embodiment is shown. The lift truck 10 can include an operator compartment 12, and a vertically extendable mast 14 mounted relative to the operator compartment 12. The mast 14 can include a first mast section 16 (as illustrated, a base section) and a second mast section 20 (as illustrated, an outer telescopic section). It should be appreciated that the operator compartment 12 may not be necessary for certain remote controlled embodiments.

Figures 2A, 2B, 2C, 2D:
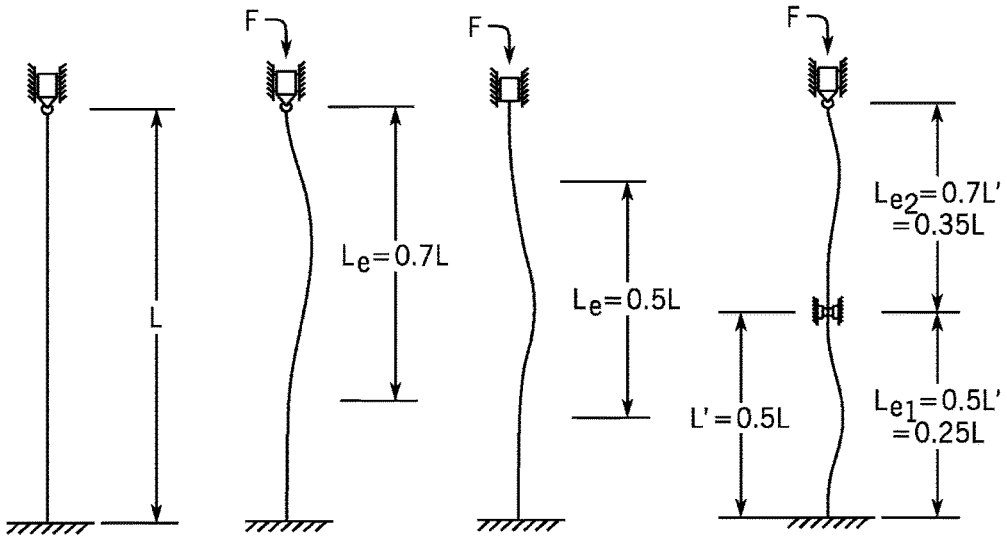
FIG. 2A is a generalized column under axial loading with an end condition.
FIG. 2B is a generalized column under axial loading with another end condition.
FIG. 2C is a generalized column under axial loading with another end condition.
FIG. 2D is a generalized column under axial loading with another end condition.
Figure 3:
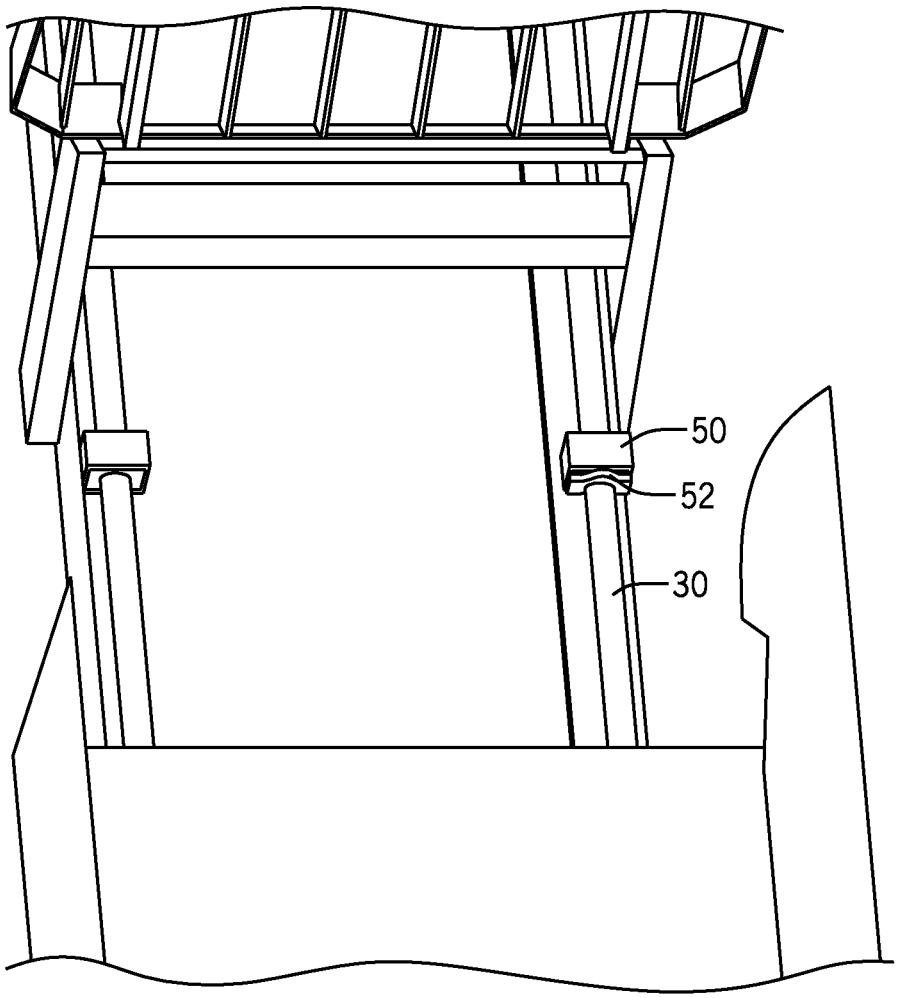
FIG. 3 is rear view of a cylinder retention mechanism of a lift truck according to the present invention.
Figure 6:
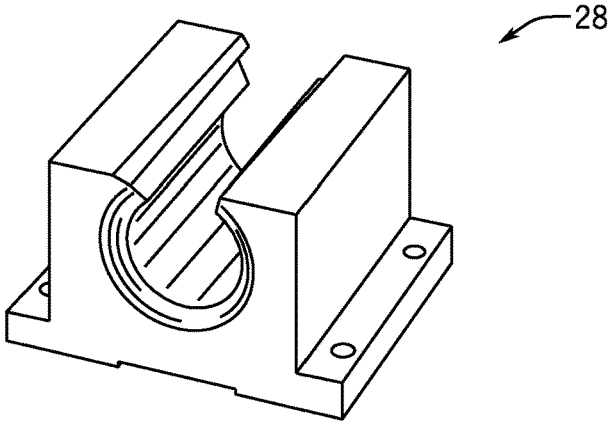
FIG. 6 is a cylinder housing retention mechanism according to the present invention for use in upper cylinder housing retention.
Figure 7:
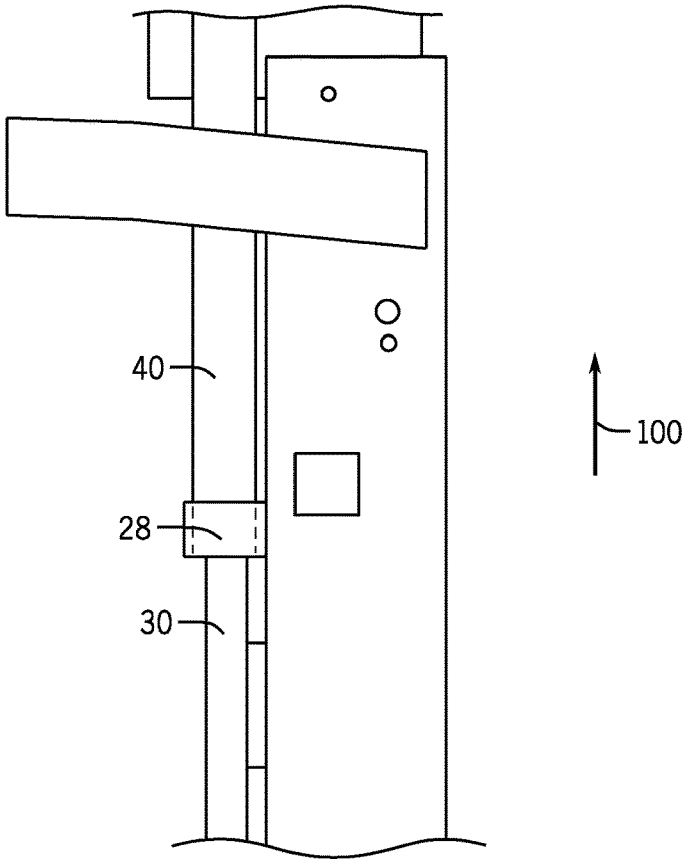
FIG. 7 is side view of cylinder housing retention mechanism according to the present invention with a linear bushing.

To illustrate the concept of effective length, FIGS. 2A-2D shows the effective length of a generalized column or beam with various end conditions. FIG. 2B shows a fixed-pinned column of length L under applied load F. For a fixed-pinned configuration, the effective length is 0.7 L. FIG. 2C shows that fixing both ends of the column results in an effective length of 0.5 L. By introduction of a fixed condition in the center of the column, as shown in FIG. 2D, the original length of the cylinder is halved and results in a fixed-fixed condition for the bottom half and a fixed-pinned condition for the top half. New effective lengths can be found for the two sections. The effective length of the bottom section, fixed-fixed, is the original column length divided by 2 and multiplied by 0.5 (the scaling coefficient for fixed-fixed). Thus, the effective length for the bottom half is 0.25 L. The effective length of the top section, fixed-pinned, is the original column length divided by 2 and multiplied by 0.7 (the scaling coefficient for fixed-pinned). The effective length for the top half is then 0.35 L. Comparing the effective lengths of FIG. 2B and the largest of worst case for FIG. 2D, the effective length has been reduced by a factor of 2. Referring again to equation 1 and FIGS. 2A-2D, reducing the effective length by a factor of 2 results in a 4-fold increase in critical buckling load.

As shown in FIGS. 1, 3, 5, and 7-9B, the mast 14 can be raised to an extended position and lowered to a retracted position by at least one lift cylinder 24. The mast 14 can be extended and retracted along an axial direction 100. Each lift cylinder 24 may include a cylinder housing 40 and a piston rod 30. The piston rod 30 can be fastened to a first mast rail member 18. The cylinder housing 40 can be fastened to a second mast rail member 22. When the lift cylinder 24 is extended, a piston rod retention mechanism 26 may restrict the lateral movement of the lift cylinders 24 relative to the axial direction 100.

The mast 14 can have a carriage affixed to it that is suitable for use with the present invention, which can further have affixed a means of transporting a load such as a platform or a fork.

The mast 14 can include a first mast section 16 and a second mast section 20. The mast can optionally include additional mast sections, up to a maximum amount that space and weight limitations may allow. The second mast section 20 moves telescopically with respect to the first mast section 16. The first mast section 16 can include at least one first mast rail member 18. The second mast section 20 can include at least one second mast rail member 22. The at least one first mast rail member 18 and the at least one second mast rail member 22 may be aligned along an axial direction 100, which in certain embodiments can be upright. The at least one first rail member 18 and the at least one second rail member may be movably coupled to one another, which in certain embodiments can be telescopically coupled to one another. In embodiments with at least two first rail members 18 or at least two second rail members 22, the first rail members 18 or second rail members 22 can be spaced apart.

In certain embodiments, the first mast section 16 can be a base section or main frame and the second mast section 20 can be an outer telescopic section. In certain embodiments, the first mast section 16 can be an outer telescopic section and the second mast section 20 can be an inner telescopic section.

The lift cylinder 24 can include a piston rod 30 and a cylinder housing 40. The lift cylinder can be hydraulic or operable by a linear actuator, such as a ball screw mechanism. In certain embodiments, the lift truck 10 can include multiple lift cylinders 24.

The piston rod 30 can have a bottom that can be coupled to the first mast section 16. The cylinder housing 40 can have a top that can be coupled to the second mast section 20.

The lift truck 10 may contain at least one piston rod retention mechanism 26. In certain embodiments, the lift truck 10 contains more than one piston rod retention mechanisms 26 to retain a single lift cylinder 24. In embodiments having at least two piston rod retention mechanism 26 to retain a single lift cylinder 24, the at least two piston rod retention mechanisms 26 may be evenly spaced along the lift cylinder 24 or may be unevenly spaced along the lift cylinder 24.

FIGS. 4, 5, and 8A-9B show a piston rod retention mechanism 26. As shown in FIGS. 4 and 5, the piston rod retention mechanism 26 can include a retention fixture 50 and a selectively engaged portion 54 or autocoupling bushing 52.

Referring to FIGS. 4 and 5, the function of one embodiment of the piston rod retention mechanism 26 will be described. In the retracted position, the selectively coupled portion 52 can be coupled to the cylinder housing bottom 48. When the lift cylinder 24 is being extended, the selectively coupled portion 52 (for example, autocoupling bushing 52) moves upward with the cylinder housing 40 until the selectively coupled portion 52 can be stopped by the retention fixture 50. Once this occurs, the selectively coupled portion 52 is no longer magnetically coupled to the cylinder housing bottom 48 and becomes magnetically coupled to the retention fixture 50. When the lift cylinders 24 are being retracted, the selectively coupled portion 52 can be pushed away from the retention fixture 50 by the motion of the cylinder housing 40. Once this occurs, the selectively coupled portion 52 is no longer magnetically coupled to the retention fixture 50 and becomes magnetically coupled to the cylinder housing bottom 48. The retention bushing capture 56 keeps the selectively coupled portion 52 centered and movably coupled to the piston rod 30.

FIG. 4 shows the selectively coupled portion 52 magnetically coupled by way of a magnetic couple 58 to the bottom portion 48 of the cylinder housing. FIG. 5 shows the selectively coupled portion 52 magnetically coupled by way of a magnetic couple 58 to the piston rod retention fixture 50.

As shown in FIGS. 8A-9B, in an alternative embodiment, the selective coupling mechanism can be operated by spring-like forces or linear actuation of any sort, including electric, hydraulic, and pneumatic actuation, or any combination thereof. The retention mechanism 26 can have a retention fixture 50 and a selectively engaged portion 54 (for example, a retention fork 54). The selectively engaged portion can have a force applied to it by a linear actuator 60 (for example, a spring 60).

Figure 8A:
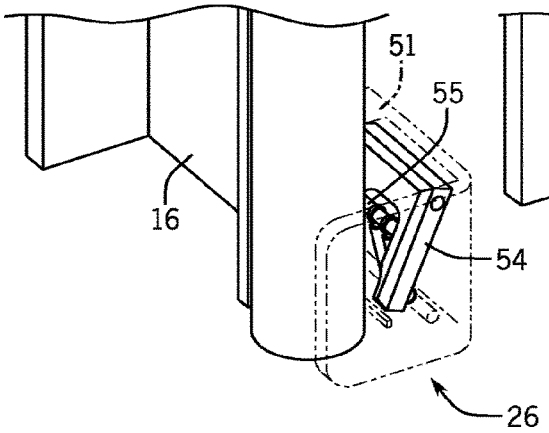
FIG. 8A is a perspective view of a disengaged alternative piston rod retention mechanism.
Figure 8B:
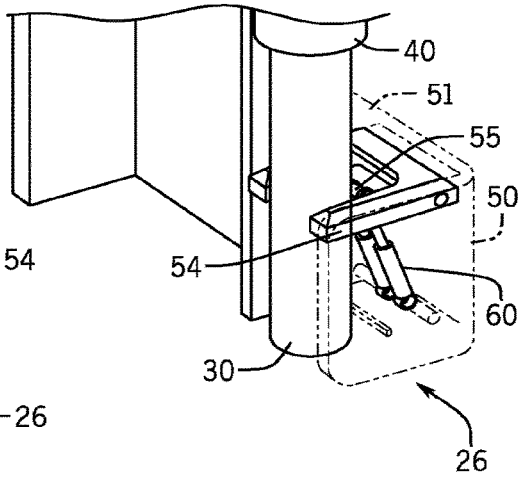
FIG. 8B is a perspective view of an engaged alternative piston rod retention mechanism.
Figure 9A:
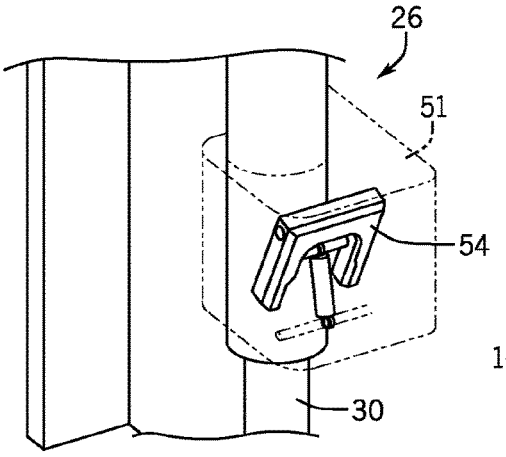
FIG. 9A is a perspective view of a disengaged alternative piston rod retention mechanism.
Figure 9B:
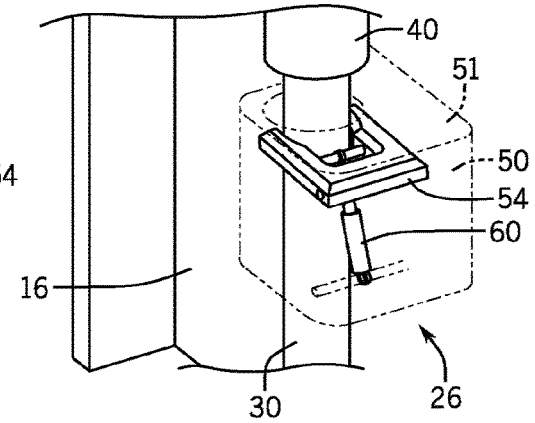
FIG. 9B is a perspective view of an engaged alternative piston rod retention mechanism.

When the lift cylinder is in an extended position (as shown in FIGS. 8B and 9B), the selectively engaged portion 54 can be retained in a position suitable to engage the piston rod 30 by a force provided by the linear actuator 60 that presses the selectively engaged portion 54 against a stopping surface 51 (for example, a top surface 51 of the retention fixture 50). When the lift cylinder is in a retracted position (as shown in FIGS. 8A and 9A), the selectively engaged portion 54 can be retained in a position that allows the cylinder housing 40 to occupy or pass through the retention fixture 50 by virtue of the cylinder housing 40 preventing the selectively engaged portion 54 from being pressed against the stopping surface 51. In the retracted position, a force provided by the linear actuator 60 can press the selectively engaged portion 54 against the cylinder housing 40, such that the selectively engaged portion 54 engages the cylinder housing 40 at a contact area 55 on the selectively engaged portion 54.

When the lift cylinder 24 moves from the retracted position (as shown in FIGS. 8A and 9A) to the extended position (as shown in FIGS. 8B and 9B), the cylinder housing 40 can be removed from the retention fixture, so that the cylinder housing may no longer prevent the selectively engaged portion 54 from reaching the stopping surface 51, so a force from the spring 60 can move the selectively engaged portion 54 (for example, the retention fork 54) to contact the stopping surface, thereby enabling the selectively engaged portion 54 to engage the piston rod 30. When the lift cylinder 24 moves from the extended position (as shown in FIGS. 8B and 9B) to the retracted position (as shown in FIGS. 8A and 9A), the cylinder housing 40 contacts the selectively engaged portion 54 and, as the cylinder housing 40 moves, the selectively engaged portion is moved away from the stopping surface 51 until the cylinder housing 40 is engaged by the contact area 55 on the selectively engaged portion 54, thereby enabling the cylinder housing 40 to be positioned within the retention fixture 50 and thereby enabling the selectively engaged portion 54 to engage the cylinder housing 40 at the contact area 55.

In certain embodiments, the retention fixture 50 may not move relative to the piston rod 30.

Figure 12:
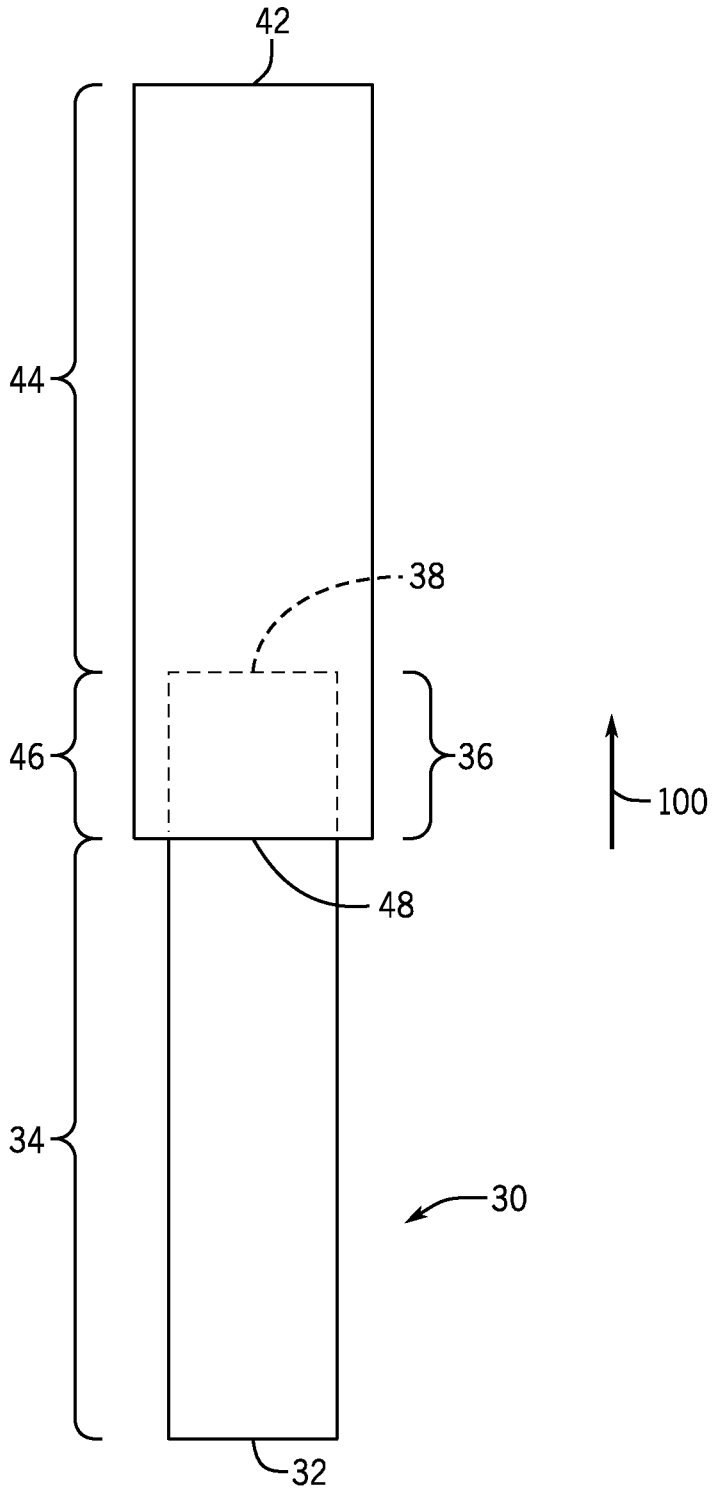
FIG. 12 is a cross-sectional view of a lift cylinder in an extended position according to the present invention.

Referring to FIG. 12, the lift cylinder 24 is shown in the extended position. The piston rod 30 can have a piston rod bottom 32, a piston rod top 38, an exposed portion 34 that is positioned outside the cylinder housing, and an internal portion 36 that is positioned within the cylinder housing 40. The cylinder housing 40 can have a cylinder housing top 42, a bottom 48, an empty portion 44 that does not have the piston rod positioned within it, and a filled portion 46 that has the piston rod positioned within it. The halfway point of the exposed portion 34 and the halfway point of the empty portion 44 represent the vertical midpoint of the piston rod 30 and the cylinder housing 40, respectively. In certain embodiments, a piston rod retention mechanism 26 may be positioned at about the vertical midpoint of the exposed portion 34 of the piston rod 30. In certain embodiments, a cylinder housing retention mechanism 28 may be positioned at about the vertical midpoint of the empty portion 44 of the cylinder housing.

In certain embodiments, a piston rod retention mechanism 26 may be at a position along the exposed portion 34 of the piston rod 30 at a distance from the piston rod bottom 32 between about 1% and about 99% of the length of the exposed portion 34, including but not limited to, a distance between about 10% and about 90%, between about 25% and about 75%, between about 33% and about 67%, and between about 45% and about 55% of the length of the exposed portion 34.

In certain embodiments, a cylinder housing retention mechanism 28 may be at a position along the empty portion 44 of the cylinder housing at a distance from the cylinder housing top 42 between about 1% and about 99% of the length of the empty portion 44, including but not limited to, a distance between about 10% and about 90%, between about 25% and about 75%, between about 33% and about 67%, and between about 45% and about 55% of the length of the empty portion 44. In certain embodiments, a cylinder housing retention mechanism 28 may be at a position along the filled portion 46 of the cylinder housing 40.

In certain embodiments, a piston rod retention mechanism 26 may be positioned at a location that equalizes the effective length of the portions of the exposed portion 34 of the piston rod 30 that are located above and below the piston rod retention mechanism 26. In certain embodiments having at least two piston rod retention mechanisms 26 for an individual lift cylinder 24, the piston rod retention mechanisms 26 may be positioned at locations that equalize the effective length of the portions of the exposed portion 34 of the piston rod 30 that are located above the upper-most piston rod retention mechanism 26, below the lower-most piston rod retention mechanism 26, and between the two or more piston rod retention mechanisms.

In certain embodiments, a cylinder housing retention mechanism 28 may be positioned at a location that equalizes the effective length of the portions of the empty portion 44 of the cylinder housing 40 that are located above and below the cylinder housing retention mechanism 28. In certain embodiments having at least two cylinder housing retention mechanisms 28 for an individual lift cylinder 24, the cylinder housing retention mechanisms 28 may be positioned at locations that equalize the effective length of the portions of the empty portion 44 of the cylinder housing that are located above the upper-most cylinder housing retention mechanism 28, below the lower-most cylinder housing retention mechanism 28, and between the two or more cylinder housing retention mechanisms.

It should be appreciated that changing the load of the lift truck may impact the number of and placement of the piston rod retention mechanisms or cylinder housing retention mechanisms. In general, a heavier load will require more retention mechanisms spaced more closely to one another.

In certain embodiments, the lift truck 10 may comprise a sensor for determining if the piston rod retention mechanism 26 is engaged with the piston rod 30 when the mast 14 is in the extended position. The sensor may be an optical sensor, an electronic sensor, a proximity sensor, a magnetic sensor, a capacitive sensor, any combination thereof, or other sensors that a person having ordinary skill in the art would recognize as capable of serving the purpose of determining if the piston rod retention mechanism 26 is engaged with the piston rod 30. The sensor may measure a property of the spring 60, a position of the selectively coupled portion 52 (for example, autocoupling bushing 52) or selectively engaged portion 54 (for example, retention fork 54), or the like. The sensor may be operated by a controller, such as a computer processor.

In certain embodiments, the sensor can be coupled to an alarm. The alarm may notify a user if the sensor indicates that the piston rod retention mechanism 26 is not engaged with the piston rod 30 when the mast 14 is in the extended position. The alarm may be positioned on the lift truck 10, on a remote controlling device, on a smart phone or other portable electronic device, any combination thereof, or in a position that a person having ordinary skill in the art would recognize as visible, audible, or tactile to an operator of the lift truck 10.

It is to be appreciated that the use of the terms first and second is not intended to be limiting or indicate any order. Descriptions such as primary and secondary, or A and B may also be used and would remain consistent with the present disclosure.

A preferred embodiment of the invention has been described in considerable detail. Many modifications and variations to the preferred embodiment described will be apparent to a person of ordinary skill in the art. Therefore, the invention should not be limited to the embodiment described.

We claim:

1. A lift truck comprising:

a mast comprising:

a first mast section having a first mast rail member;

a second mast section having a second mast rail member movably coupled to the first mast rail member and movable along an axial direction relative to the first mast rail member between a retracted position and an extended position;

a lift cylinder comprising a piston rod and a cylinder housing disposed concentrically about the piston rod and movably coupled to the piston rod along the axial direction, the piston rod having a piston rod bottom and an outer piston rod diameter, the cylinder housing having a cylinder housing top and an outer cylinder housing diameter that is larger than the outer piston rod diameter; and a piston rod retention mechanism affixed to the first mast rail member, the lift cylinder is operable to extend and retract the mast in the axial direction by moving the second mast section with respect to the first mast section, and the piston rod retention mechanism restricts movement of the lift cylinder in a direction lateral to the axial direction when the mast is in the extended position and is movable such that, when the mast is in the retracted position, the piston rod retention mechanism is coupled to the cylinder housing, when the mast is in at least one intermediate position between the retracted position and the extended position, the piston rod retention mechanism is coupled to the cylinder housing, and when the mast is in the extended position, the piston rod retention mechanism is decoupled from the cylinder housing.

2. The lift truck according to claim 1:

wherein the piston rod retention mechanism is positioned to at least double a critical buckling load of the lift cylinder in the extended position in relation to a critical buckling load of the lift cylinder in the extended position in the absence of the piston rod retention mechanism.

3. The lift truck according to claim 1:

the mast further comprising a cylinder housing retention mechanism coupled to the mast and slidably coupled to the cylinder housing, the cylinder housing retention mechanism restricts movement of the lift cylinder in a direction lateral to the axial direction when the mast is in the extended position.

4. The lift truck according to claim 3:

wherein the piston rod retention mechanism and the cylinder housing retention mechanism are positioned to at least double a critical buckling load of the lift cylinder in relation to a critical buckling load of the lift cylinder in the absence of the piston rod retention mechanism and the cylinder housing retention mechanism.

5. The lift truck according to claim 3:

wherein the piston rod retention mechanism engages the piston rod and the cylinder housing retention mechanism engages the cylinder housing when the mast is in the extended position.

6. The lift truck according to claim 5:

wherein the piston rod has an exposed portion that is positioned outside the cylinder housing when the mast is in the extended position and an internal portion that is positioned within the cylinder housing when the mast is in the extended position, wherein the cylinder housing has an empty portion that does not have the piston rod positioned within it when the mast is in the extended position and a filled portion that has the piston rod positioned within it when the mast is in the extended position, and wherein the piston rod retention mechanism is at a position along the exposed portion of the piston rod at a distance from the piston rod bottom between about 1% and about 99% of the length of the exposed portion, wherein the cylinder housing retention mechanism is at a position along the filled portion of the cylinder housing, or wherein the cylinder housing retention mechanism is at a position along the empty portion of the cylinder housing at a distance from the cylinder housing top between about 1% and about 99% of the length of the empty portion.

7. The lift truck according to claim 1:

wherein the piston rod retention mechanism comprises a piston rod retention fixture and a selectively coupled portion or a selectively engaged portion.

8. The lift truck according to claim 7:

wherein the selectively coupled portion couples to the piston rod retention fixture when the mast is in an extended position, wherein the selectively coupled portion couples to the cylinder housing when the mast is in a retracted position, wherein the selectively engaged portion engages the piston rod when the mast is in the extended position, and wherein the selectively engaged portion disengages the piston rod when the mast is in the retracted position.

9. The lift truck according to claim 7:

wherein the piston rod retention fixture comprises a retention bushing capture.

10. The lift truck according to claim 1:

wherein the lift cylinder is hydraulic.

11. The lift truck according to claim 1:

wherein the piston rod bottom is affixed to the first mast section or the cylinder housing top is affixed to the second mast section.

12. A piston rod retention mechanism for use with a lift cylinder having a piston rod with an outer piston rod diameter, the piston rod movably coupled to a cylinder housing disposed concentrically about the piston rod and having an outer cylinder housing diameter that is larger than the outer piston rod diameter, wherein the cylinder housing moves in an axial direction relative to the piston rod, the piston rod retention mechanism comprising:

a retention fixture having an internal shape to enable movable coupling between the cylinder housing and the retention fixture, wherein the cylinder housing is positioned within the retention fixture in a retracted position and is positioned outside the retention fixture in an extended position; and a selectively coupled portion or selectively engaged portion having an internal shape to enable movable coupling between the piston rod and the selectively coupled portion or selectively engaged portion, the retention fixture does not move relative to the piston rod, the selectively coupled portion is coupled to a bottom of the cylinder housing in the retracted position, and the selectively coupled portion is coupled to the fixed portion and decoupled from the bottom of the cylinder housing by a movement from the retracted position to the extended position, the selectively coupled portion is selectively decoupled from the fixed portion and coupled to the bottom of the cylinder housing by a movement from the extended position to the retracted position, the selectively engaged portion is engaged to the piston rod by the movement from the retracted position to the extended position, or the selectively engaged portion is disengaged from the piston rod by the movement from the extended position to the retracted position.

13. The piston rod retention mechanism according to claim 12:

wherein the selectively coupled portion or the selectively engaged portion is selectively engaged to the piston rod or selectively coupled to the fixed portion by magnetic forces, by spring-like forces, by linear actuation forces, or a combination thereof.

14. The piston rod retention mechanism according to claim 12:

wherein the selectively engaged portion is a retention fork and the selectively coupled portion is an autocoupling bushing.

15. A lift truck, the lift truck comprising a mast comprising:

a first mast section comprising a first mast rail member;

a second mast section comprising a second mast rail member movably coupled to the first mast rail member along an axial direction relative to the first mast rail member, such that the mast is movable between a retracted position and an extended position;

a lift cylinder comprising a piston rod having an outer piston rod diameter and a cylinder housing disposed concentrically about the piston rod and movably coupled to the piston rod along the axial direction; and a piston rod retention mechanism affixed to the first mast rail member, the piston rod retention mechanism comprises a fixed portion having an internal shape to enable movable coupling between the cylinder housing and the fixed portion and a selectively coupled portion or selectively engaged portion having an internal shape to enable movable coupling between the piston rod and the selectively coupled portion or selectively engaged portion, and the piston rod retention mechanism is movable such that, when the mast is in the retracted position, the selectively coupled portion or selectively engaged portion is coupled to the cylinder housing, when the mast is in at least one intermediate position between the retracted position and the extended position, the selectively coupled portion or selectively engaged portion is coupled to the cylinder housing, and when the mast is in the extended position, the selectively coupled portion or selectively engaged portion is decoupled from the cylinder housing.

16. The lift truck according to claim 15:

wherein the piston rod retention mechanism is positioned to at least double a critical buckling load of the lift cylinder in the extended position in relation to a critical buckling load of the lift cylinder in the extended position in the absence of the piston rod retention mechanism.

17. The lift truck according to claim 15:

the mast further comprising a cylinder housing retention mechanism affixed to the first mast section or the second mast section and movably coupled to the cylinder housing, the cylinder housing retention mechanism restricts movement of the lift cylinder in a direction lateral to the axial direction when the mast is in the extended position.

18. The lift truck according to claim 17:

wherein the piston rod retention mechanism and the cylinder housing retention mechanism are positioned to at least double a critical buckling load of the lift cylinder in relation to a critical buckling load of the lift cylinder in the absence of the piston rod retention mechanism and the cylinder housing retention mechanism.

19. The lift truck according to claim 15:

wherein the piston rod retention mechanism comprises a piston rod retention fixture and a selectively coupled portion or a selectively engaged portion.

20. The lift truck according to claim 15:

wherein the lift cylinder is hydraulic.

* * * * *